US005235388A

United States Patent [19]

Rimai et al.

[11] Patent Number: 5,235,388

[45] Date of Patent: Aug. 10, 1993

[54] METHOD AND APPARATUS FOR DETERMINING TONER CHARGE-TO-MASS RATIO

[75] Inventors: Donald S. Rimai, Webster; Mark C. Zaretsky, Rochester; Bruno Primerano, Webster, all of N.Y.

[73] Assignee: Eastman Kodak Company, Rochester, N.Y.

[21] Appl. No.: 896,868

[22] Filed: Jun. 12, 1992

[51] Int. Cl.[5] ..... G03G 15/08; G03G 21/00

[52] U.S. Cl. ..... 355/246

[58] Field of Search ..... 355/246, 251, 208, 245

[56] References Cited

U.S. PATENT DOCUMENTS

| | | | |
|---|---|---|---|
| 4,026,643 | 5/1977 | Bergman | 355/246 |
| 4,447,145 | 5/1984 | Snelling et al. | 355/246 X |
| 4,987,453 | 1/1991 | Laukaitis | 355/246 |
| 5,006,897 | 4/1991 | Rimai et al. | 355/246 |

*Primary Examiner*—Fred L. Braun
*Attorney, Agent, or Firm*—Dennis R. Arndt

[57] ABSTRACT

A method and apparatus for determining the charge-to-mass ratio of electroscopic toner particles of the type used in electrostatographic recording to develop electrostatic images. The apparatus uses a biased electrode for attracting toner particles thereto, and a microprocessor-based logic and control unit for sampling the mass of toner particles deposited on the electrode after the deposited toner particles have neutralized the electric field produced by the electrode bias. This toner mass information, together with certain toner constants and known parameters, is used by the logic and control unit to calculate the toner's charge-to-mass ratio. The output of the apparatus is useful for controlling process parameters (e.g. primary charging and exposure levels, development electrode bias, toner concentration) which affect image quality.

8 Claims, 2 Drawing Sheets

METHOD AND APPARATUS FOR DETERMINING TONER CHARGE-TO-MASS RATIO

CROSS-REFERENCE TO RELATED APPLICATIONS

Reference is made to the commonly assigned U.S. Pat. No. 07/896,866, filed concurrently herewith in the names of D.S. Rimai, M.C. Zaretsky, B. Primerano and D.D. Almeter entitled "METHOD AND APPARATUS FOR DETERMINING TONER DEVELOPMENT RATE".

BACKGROUND OF THE INVENTION

1. Field of the Invention

The present invention relates to the field of electrostatographic recording, such as electrophotography and electrography. More particularly, it relates to improvements in apparatus and methods for monitoring certain properties which characterize the electroscopic toner particles used in electrostatographic recording devices to develop electrostatic charge patterns and images.

2. Discussion of the Prior Art

It is well known that the quality of images produced by the electrostatographic image recording process is controllable by varying certain process parameters. These parameters include, for example, the primary charging voltage to which the image-recording element is initially charged; the amount of exposure received by the recording element for the purpose of imagewise dissipating the initial charge to form a developable charge pattern; the bias voltage applied to a development electrode during the development of the charge image; and the concentration of electroscopic toner in a development mixture of toner and carrier particles. Other important process parameters are the electrostatic charge-to-mass ratio of the toner particles comprising the developer, and the rate at which toner particles are accepted by the electrostatic charge-bearing member to effect development thereof. The latter parameter is known as the mass deposition rate or, more simply, the development rate.

Many factors influence the charge-to-mass ratio and development rate of toner particles. These factors include relative humidity, toner concentration, chemical contamination, and developer mixture aging. With respect to the latter, all developer mixtures contain toner particles having diameters which vary within a specified range. For a variety of reasons, a charge image will more readily accept larger toner particles than smaller ones. Thus, with continued use of the same developer mass, there will be a gradual decrease in the average toner particle size in the developer mass. This, in turn, gives rise to an increase in the charge-to-mass ratio of the developer, and a decrease in the development rate.

Increases in the developer's charge-to-mass ratio usually result in a decrease in density of a developed image since fewer toner particles will be required to fully develop and thereby neutralize the charge image. On the other hand, decreases in the charge-to-mass ratio gives rise to over-development of the charge image since more particles are required for charge neutralization. Similarly, a decrease in toner's development rate will often give rise to a decrease in image density, and vice versa. Accordingly, it is desirable to monitor the charge-to-mass ratio and development rate of a toner so that other process parameters can be adjusted to compensate for changes in these parameters. Feedback control can be used to adjust any of the aforementioned parameters to adjust image quality in response to changes in the charge-to-mass ratio and/or development rate.

In the commonly assigned U.S. Pat. No. 5,006,897 to D.S. Rimai et al., there is disclosed an apparatus for monitoring the development rate and charge-to-mass ratio of a moving mass of toner particles which is being applied to a charge image to effect development. Such apparatus includes a piezoelectric crystal having a planar electrode disposed on one surface thereof. The crystal and its associated electrode are positioned in the toner mass, and the electrode is electrically biased to attract toner to its depends upon the bias voltage on the electrode charge on the toner. The greater the charge on the toner, the smaller the amount toner required to neutralize it. By energizing the crystal and measuring the shift in frequency caused by the deposition of toner on the biased electrode, a determination is made of the toner mass deposited on the electrode. The amount of charge on the toner is determined by a transient current measuring scheme in which the time interval required for the charge on the electrode to decay to a predetermined level is measured. The measured toner charge (as reflected by the measured charge decay time) is divided by the measured toner mass (as reflected by the measured frequency of oscillation of the crystal after the charge decay time) to produce a signal proportional to the charge-to-mass ratio. Moreover, by dividing the measured toner mass by the measured charge decay time, the toner mass deposition rate (i.e. the development rate) is determinable.

While the apparatus disclosed in the above-noted patent is useful in determining both charge-to-mass and development rate parameters, it is subject to certain limitations. For example, if either the toner or carrier particles comprising the developer are electrically conductive in nature, a DC signal may mask the transient current signal, making it difficult to detect. Also, the combined transient current and mass measurements require several variables to be determined simultaneously, including the toner mass deposited, the time needed to deposit that toner and the transient current. Finally, since the development rate varies as a function of the difference in bias potential between the toner applicator and the crystal, the transient current measurement only gives the average development rate over the charge decay time.

SUMMARY OF THE INVENTION

In view of the foregoing discussion, an object of this invention is to simplify the determination of the charge-to-mass ratio of a given developer.

According to the present invention, the above object is achieved by a method and apparatus which requires only a toner mass measurement in order to determine the toner's charge-to-mass ratio. The apparatus of the invention is characterized in that the bias voltage applied to a toner-attracting electrode (e.g., disposed on a piezoelectric crystal) is chosen so that the electric field produced by such bias voltage is totally neutralized by less than a monolayer of the toner particles deposited on the electrode as a result of the applied bias thereon. After the toner deposited on the electrode has accumulated to the point that the toner charge has neutralized the electric field created by the electrode bias, a logic and control unit (comprising, e.g., a suitably programmed microprocessor) samples the mass of the toner particles deposited on the electrode. Preferably, this sampling is done by detecting a change in resonant frequency of a piezoelectric crystal to which the electrode is operatively coupled. The toner mass information is then used to calculate the toner charge-to-mass ratio, q/m. Preferably, this calculation is based on the following relationship:

$$q/m = \frac{2 V \epsilon A}{m d},$$

where V is the net bias voltage applied to the electrode (i.e., the difference between the respective bias voltages applied to the toner applicator and the electrode); $\epsilon$ is the dielectric constant of the toner particles; A is the area of the electrode on which the toner particles are deposited; and d is the average diameter of the toner particles.

Since there is no need to measure the above-mentioned transient current in the apparatus and method of the invention, the above-noted complication associated with conductive toners or carriers is eliminated. As only the toner mass is being determined, the charge-to-mass determination is simplified.

The invention and its advantages will be better understood from the ensuing detailed description of preferred embodiments, reference being made to the accompanying drawings.

DETAILED DESCRIPTION OF PREFERRED EMBODIMENTS

Figure 1:
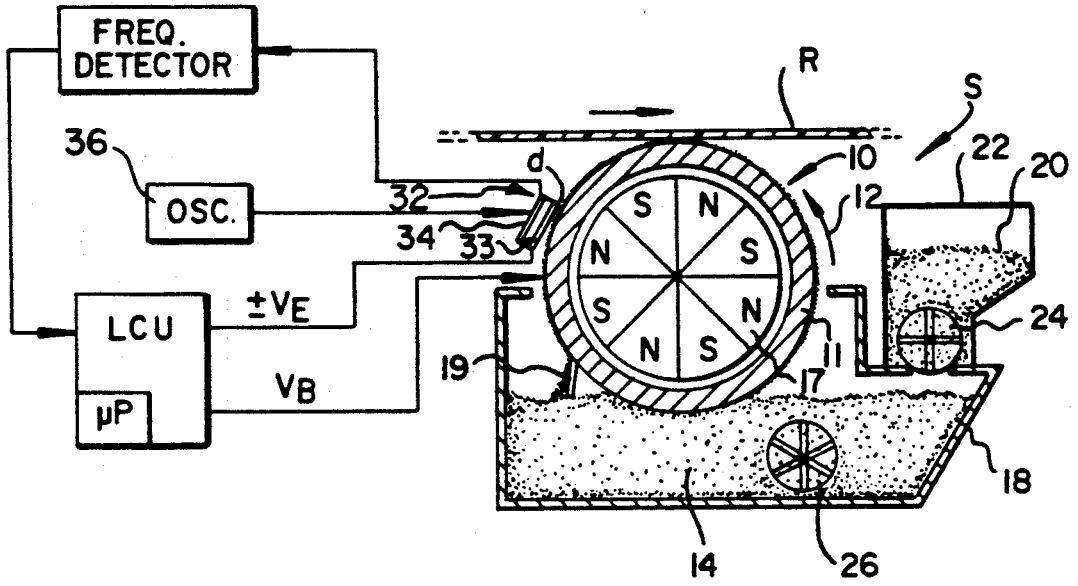
FIG. 1 is a schematic illustration of a preferred embodiment of the apparatus of the invention.

In FIG. 1, the apparatus of the invention is shown embodied in a conventional magnetic brush-type development station S of the type which operates to apply a mass of electroscopic toner particles to a latent charge pattern previously formed on a recording element R to effect development of such charge pattern. The development station may form part of an electrostatographic image recording apparatus, such as an electrophotographic document copier or printer. From the ensuing description, it will be appreciated that the apparatus of the invention is also useful in other types of toner-applying devices.

The development station S of FIG. 1 includes a magnetic brush 10 comprising a non-magnetic, electrically-conductive sleeve 11 which may be rotatably driven in the direction of the arrow 12 to transport a developer 14 from a hopper 18 into contact with the recording element. The developer typically comprises a two-component mixture of pigmented, thermoplastic toner particles and magnetically attractable carrier particles. The carrier particles are magnetically attracted toward the outer surface of sleeve 11 by an internal magnetic core piece 17 which may or may not rotate. Each carrier particle usually supports a large number of toner particles which are considerably smaller than the carrier particles and adhere thereto by triboelectric forces. The toner particles themselves are usually charged to a polarity opposite that of the charge pattern being developed and, during contact with the charge pattern, the toner particles are stripped from the carrier particles by the stronger electrostatic forces of the charge pattern, and deposited on the recording element. The partially denuded carrier particles are then scrapped from the brush surface by a skive 19 and returned to the hopper. There, the carrier particles are mixed with fresh toner 20 supplied from a sump 22 via a valve or gate 24. The latter is controlled by a microprocessor-based logic and control unit LCU, which is suitably programmed in a conventional manner to adjust all process parameters, as needed. A mixing auger 26 serves to mix the carrier with toner and thereby refresh each carrier particle with toner. As is common, the magnetic brush is electrically biased to a suitable reference voltage $V_B$ to prevent the development of the background areas of the charge pattern. The level of the brush bias voltage depends on the primary charge level on the recording element, and the level of exposure received by the recording element. As shown, the brush's bias voltage is provided by the LCU and is typically between about 100 and 500 volts.

As indicated above, a key parameter in controlling the quality of images produced by electrostatographic recording apparatus is the instantaneous value of the charge-to-mass ratio of the toner used to develop the charge pattern. This parameter continuously undergoes change and, unless controlled or otherwise compensated for, will dramatically affect image quality.

Figure 2:
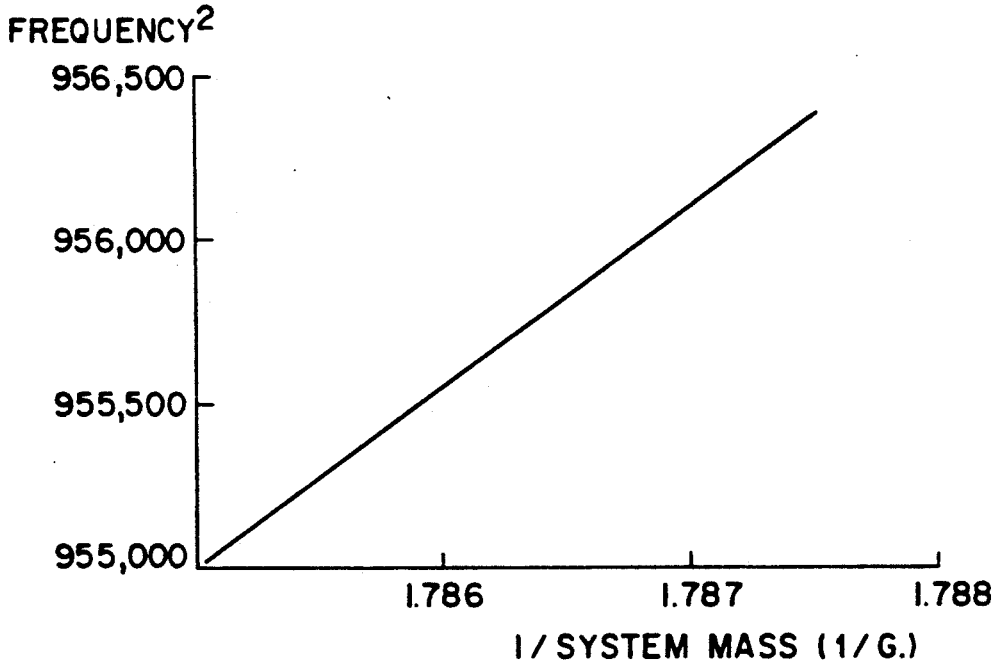
FIG. 2 is a graph illustrating the manner in which the resonant frequency of a piezoelectric crystal varies with the mass of toner deposited thereon.

In accordance with the present invention, preferred apparatus for selectively determining the charge-to-mass ratio of the toner particles being applied by the development station of FIG. 1 comprises a piezoelectric crystal 32 having opposing electrodes 33,34 disposed on its respective opposing faces. The details of the piezoelectric member are disclosed in the aforementioned U.S. Pat. No. 5,006,897, the contents of which are incorporated herein by reference. At selected times intervals, the LCU applies a bias voltage, $\pm V_E$ to electrode 33, causing it to either attract or repel toner particles, depending on the charge polarity of the toner. Note, the toner repelling voltage (used to cleanse the electrode of toner) need not be of the same amplitude as the toner-attracting voltage. An oscillator circuit 36 is operatively coupled to the crystal to cause it to oscillate at its nominal resonant frequency (e.g., 1 Megahertz). As shown in FIG. 2, the resonant frequency of oscillation of crystal 32 depends upon its mass, the greater the mass (which includes the mass of the toner deposited on electrode 33, the lower the frequency. Crystal 32 is supported in a position closely spaced (e.g., within about 0.05 cm.) from the outer surface of brush sleeve 11, whereby electrode 33 forms one plate of a capacitive circuit in which the brush sleeve forms the other plate and the intervening developer mass provides the dielectric material.

Figure 3:
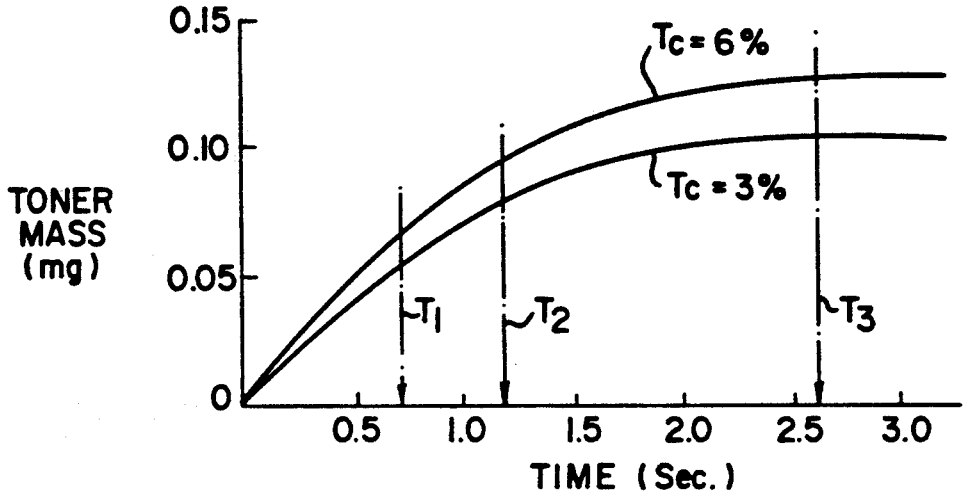
FIG. 3 is a pair of graphs illustrating manner in which toner mass build-up on a biased electrode varies with time for two different toner concentrations.

As shown in FIG. 3, the rate at which toner accumulates on electrode 33 depends upon the toner concentration, $T_c$, in the developer mix. The lower the toner concentration, the higher the charge on the toner, and the faster the accumulation of toner on the electrode. Of course, the rate of deposition (i.e., accumulation) of toner on electrode 33 is directly proportional to the rate at which the toner develops the charge pattern on the recording element R. By sampling the toner mass at times $T_1$ and $T_2$ (i.e., during the substantially linear portion of the curves where the toner is gradually depositing at a substantially uniform rate), the development rate of the toner can be determined from the slope of the respective curves shown in FIG. 3. Preferably, the bias voltage $V_E$ selectively applied to electrode 33 by the LCU is chosen so that, when the toner charge is as low as it is likely to become, no more than a monolayer of toner particles will be deposited on the electrode surface before the electric field produced by the bias voltage on the electrode is neutralized by the deposited toner. By determining the toner mass at saturation, e.g., at time $T_3$ in FIG. 3, the charge-to-mass ratio of the toner can be determined from the equation:

$$q/m = \frac{2\,V\epsilon A}{m\,d},$$

where, in this case, V is the net bias voltage applied to the electrode (i.e., the difference between the respective bias voltages applied to the toner applicator and the electrode); $\epsilon$ is the dielectric constant of the toner particles; A is the area of the electrode on which the toner particles are deposited; and d is the average diameter of the toner particles.

In the above equation, all parameters except for the toner mass m are known, making it a simple matter for the microprocessor to calculate q/m after the toner mass at saturation has been determined. It will be appreciated that the value of the toner mass accumulated by the electrode 33 is charge dependent, the larger the toner charge, the smaller the toner mass required to neutralize the electrode bias.

EXAMPLE

Two electrostatographic developers were made by mixing varying amounts of toner particles having a mean volume weighted diameter of 3.5 microns with an electrically insulating ferrite carrier. The resulting toner concentrations were 3% and 6% by weight of developer. Typical concentrations of such developers when used in electrostatographic copiers and printers to produce high quality images are in the range of 6% to 6%. An AT cut quartz crystal transducer having a nominal fundamental frequency of 1.0 MHz., a diameter of 1.25 cm., and chromegold planar electrodes plated on both sides, was used as the toner mass-detecting element 32 in the apparatus of FIG. 1. Fine wires were soldered to each of the chrome-gold planar electrodes on opposite sides of the transducer. Each of the above developer mixtures were loaded onto a magnetic development brush, and the brush was connected to ground potential. The transducer was suspended by the wires into the developer nap (i.e. the mass of developer conveyed by the moving brush) at a spacing, d, of approximately 0.05 cm. from the brush surface. The crystal was caused to socilate at its resonant frequency by connecting the wire electrodes to an oscillator circuit. A potential of −100 volts was applied to the transducer elements closer to the brush. The negative polarity of such bias voltage was chosen so that no more than a monolayer of toner particles would deposit on the electrode before the field resulting from the bias voltage would be neutralized. For each toner concentration, the toner mass on the electrode was sampled by every 10 ms. by sampling the transducer frequency and correlating it with toner mass using the graph of FIG. 2. The toner mass build-up on the electrode as a function of time for each toner concentration is illustrated by the two graphs of FIG. 3. At saturation, approximately 0.15 mg. of toner from a developer mixture having a toner concentration of 3% was determined to have been deposited on the transducer electrode. That area of the electrode receiving the deposition was determined to be about $2.53\times10^{-5}$ m$^2$, or about 20% of the area of the circularly shaped electrode. The dielectric constant of the toner was about $3\times10^{-11}$ values in the above equation produced a charge-to-mass ratio of 289 microcoulombs/gm. This number is in good agreement with that obtained by the transient current measuring method of the prior art. After each determination of the toner mass at saturation, the polarity of the electrode voltage was reversed. This had the effect of repelling the accumulated toner from the electrode and thereby rendering it clean and ready for the next toner mass measurement.

Figure 4:
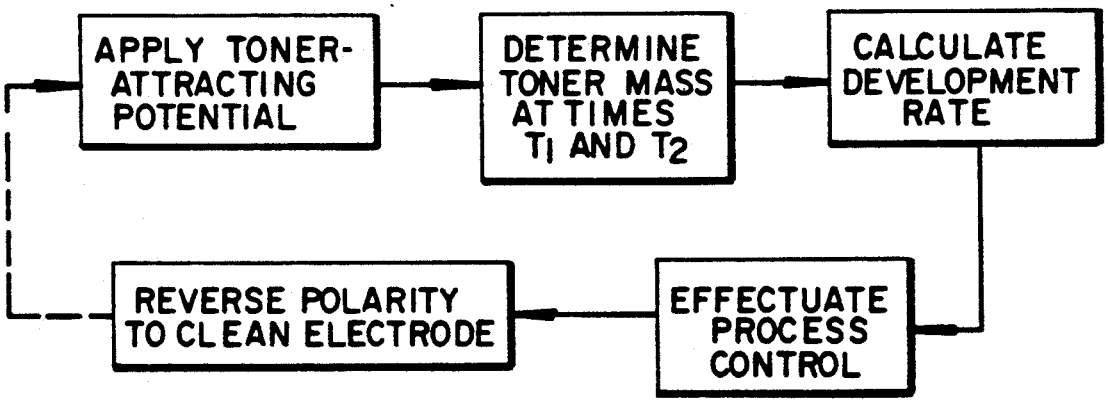
FIG. 4 is a flow chart illustrating a series of steps carried out by the microprocessor-based logic and control unit of FIG. 1.

In the FIG. 1 apparatus, the logic and control unit is programmed to carry-out the process illustrated in FIG. 4. According to the first step, the polarity of the bias voltage applied to electrode 33 is switched to a toner-attracting polarity. The next step is to determine the mass of the toner attracted to the electrode after the bias field on the electrode has been neutralized by the toner deposited on the electrode. In the preferred embodiment, this is done by determining the frequency of the piezoelectric member after stabilization, and correlating this stabilized frequency with mass (from FIG. 2). Frequency sampling is repeated as need to ensure that the assymptotic behavior has been recorded. Using the toner mass information, the charge-to-mass ratio is calculated. Based on the determined ratio, process control is effectuated, if necessary. Thereafter, the polarity on the electrode is reversed, thereby cleansing the electrode of toner. The process is then repeated, as necessary.

The invention has been described with particular reference to preferred embodiments. It will be appreciated, however, that numerous modifications and variations can be invention. Such modifications and variations are intended to fall within the scope of the appended claims.

What is claimed is:

1. In an electrostatographic recording apparatus in which latent electrostatic images on an image-recording element are developed by a toner applicator which operates to apply a mass of electrostatically charged toner particles to the image-bearing surface of the image-recording element, said toner applicator being electrically biased to a predetermined potential, apparatus for determining the electrostatic charge-to-mass ratio, q/m, of the toner particles, said apparatus comprising:

(a) an electrode positioned adjacent said toner applicator to contact said mass of toner particles;

(b) means for selectively biasing said electrode to a predetermined potential to cause toner particles from said mass to deposit on a surface of said electrode, said predetermined potential being such that the charge associated with the deposited toner operates to neutralize said predetermined potential before a monolayer of toner particles is deposited on said surface; and (c) means for selectively sensing the mass of toner particles deposited on said electrode surface after said predetermined potential has been neutralized.

2. The apparatus as defined by claim 1 further comprising means for determining the charge-to-mass ratio of the toner particles in said mass from the relationship:

$$q/m = \frac{2 V \epsilon A}{m d},$$

where V is the difference in the respective bias potentials applied to the toner applicator and electrode; $\epsilon$ is the dielectric constant of the toner particles; A is the area of said electrode surface; and d is the average diameter of the toner particles.

3. The apparatus as defined by claim 1 wherein said electrode is disposed on an electrically energized piezoelectric device having an instantaneous oscillating frequency determined by the instantaneous mass of toner deposited on said electrode, and wherein said sensing means comprises means for selectively sensing the oscillating frequency of said piezoelectric device.

4. The apparatus as defined by claim 1 wherein said sensing means operates to sample the toner mass deposited on said electrode at preselected times after said biasing means selectively biases said electrode, whereby the rate of development of the electrostatic images is determined.

5. In an electrostatographic recording process in which latent electrostatic images on an image-recording element are developed by applying a mass of electrostatically charged toner particles to the image-bearing surface of the image-recording element with an electrically biased toner applicator which is biased to a predetermined potential, a method for determining the electrostatic charge-to-mass ratio, q/m, of the toner particles, said method comprising the steps of:

(a) positioning an electrode adjacent the toner applicator to contact the mass of toner particles;

(b) selectively biasing the electrode to a predetermined potential to cause toner particles in said mass to deposit on a surface of the electrode, said predetermined potential being such that the charge associated with the deposited toner operates to neutralize said predetermined potential before a monolayer of toner particles is deposited on said surface; and (c) selectively sensing the mass of toner particles deposited on said electrode surface after said predetermined potential has been neutralized.

6. The method as defined by claim 5 further comprising the step of determining the charge-to-mass ratio of the toner particles in the mass from the relationship:

$$q/m = \frac{2 V \epsilon A}{m d},$$

where V is the difference in the respective bias potentials applied to the toner applicator and electrode; $\epsilon$ is the dielectric constant of the toner particles; A is the area of said electrode surface; and d is the average diameter of the toner particles.

7. The method as defined by claim 5 wherein the electrode is disposed on an electrically energized piezoelectric device having an instantaneous oscillating frequency determined by the instantaneous mass of toner deposited on said electrode, and wherein said sensing step comprises selectively sensing the oscillating frequency of the piezoelectric device at a predetermined time after biasing the electrode.

8. The method as defined by claim 5 wherein said sensing step comprises the step of sampling the toner mass deposited on the electrode at preselected times after selectively biasing the electrode, whereby the rate of development of the electrostatic images is determined.

* * * * *